United States Patent [19]

Franz

[11] Patent Number: 4,526,110

[45] Date of Patent: Jul. 2, 1985

[54] CANOPY FOR AN UPRIGHT DISPLAY

[75] Inventor: Leo J. Franz, Lilburn, Ga.

[73] Assignee: Leggett & Platt, Incorporated, Carthage, Mo.

[21] Appl. No.: 432,980

[22] Filed: Oct. 6, 1982

[51] Int. Cl.[3] ..... A47B 47/00

[52] U.S. Cl. ..... 108/108; 108/111

[58] Field of Search ..... 108/108, 111, 23, 6, 108/48; 211/187, 193; 248/174, 240.3

[56] References Cited

U.S. PATENT DOCUMENTS

| | | | |
|---|---|---|---|
| 2,643,170 | 6/1953 | Vanderveld | 211/193 X |
| 3,120,199 | 2/1964 | Kolster | 108/6 |
| 3,346,317 | 10/1967 | Peggs | 248/174 |
| 3,598,066 | 8/1971 | Polezoes | 108/108 |
| 3,601,256 | 8/1971 | Bowers | 108/108 |
| 3,983,822 | 10/1976 | Suttles | 108/108 |
| 4,068,551 | 1/1978 | Kreitz | 108/48 |
| 4,344,367 | 8/1982 | Merl | 211/187 X |

FOREIGN PATENT DOCUMENTS

| | | | |
|---|---|---|---|
| 2341290 | 9/1977 | France | 108/108 |

*Primary Examiner*—Francis K. Zugel

*Attorney, Agent, or Firm*—Wood, Herron & Evans

[57] ABSTRACT

An improved canopy is disclosed for a merchandise display including a front signboard assembly comprised of two side panels and a front panel. The two side panels are respectively pivotally joined at one end to horizontally opposed ends of the front panel, the pivotal joints thereby permitting the front signboard assembly to be folded in a compact arrangement facilitating transport, storage, and mounting of the assembly on a merchandise display.

1 Claim, 4 Drawing Figures

CANOPY FOR AN UPRIGHT DISPLAY

FIELD OF THE INVENTION

This invention relates generally to upright merchandise displays, and in particular to an improved canopy for an upright freestanding merchandise display wherein the canopy is provided in a form permitting ready assembly by a merchant or distributor.

BACKGROUND OF THE INVENTION

In large retail stores, such as grocery stores and supermarkets, it is necessary to display stocked merchandise to the purchasing public. Merchandise displays are consequently employed to better display the merchandise as well as serve as an advertising means, such as through the use of signboards carried by the display having advertising thereon. One form of such a merchandise display is an upright, free-standing display. Such a display is normally comprised of a base typically having a pair of rearwardly set vertically extending uprights fixed thereto. These display uprights serve as supports for a plurality of shelves which are carried by the supports in vertically spaced relation, and on which the merchandise for sale is displayed.

It has been found advantageous in upright displays of this kind to provide an attractive canopy for the display. It has been known to provide this canopy with a pair of canopy uprights which are receivable in the display uprights. A rear signboard or panel is mounted to the canopy uprights and extends therebetween. There is also a front signboard assembly mounted to the canopy uprights comprising two side signboard panels which respectively extend forwardly from the canopy uprights and a front signboard panel which extends between the two side panels. A rectangular-shaped, forwardly thrusting canopy is thus provided for the merchandise display. An optional top panel, which may be in the form of a light diffuser, is often advantageously employed to finish the canopy.

A problem presented by this foregoing type of canopy for a merchandise display is that the front signboard assembly is typically provided to the merchant or distributor in separate components, i.e., the two side panels and the front panel must be properly joined or fastened together before the canopy can be attached to the canopy uprights. The merchant or distributor setting up the canopy must consequently spend some time and effort in assembling the front signboard assembly of the canopy. This problem is multiplied by the variety of front as well as rear signboards which may be interchangeably employed with a particular merchandising display, depending upon the type of merchandise which is being shown on the display at a given time.

It would therefore be advantageous if a front signboard assembly was provided to the merchant or distributor in a pre-assembled and permanently joined state to facilitate setup of the canopy as well as interchangeability of various signboards.

SUMMARY OF THE INVENTION

With the foregoing problems in mind, it is a primary object of the instant invention to provide an improved canopy for a merchandise display. It is a particular object of this invention to provide such a display canopy with a front signboard assembly which is pre-assembled and can, therefore, be simply and quickly attached to an appropriate canopy support.

It is another object of the invention to provide an improved display canopy for a merchandise display with a folding front signboard assembly having two side panels and a front panel which are permanently pivotally joined together such that a pre-assembled folding front signboard assembly can be provided to a merchant or distributor in a compact form ready for attachment to an appropriate canopy support.

These and other objects are accomplished by the present invention in an improved display canopy for a merchandise display wherein the improvement comprises a front folding signboard assembly which is quickly and simply mounted on a pair of canopy uprights constituting the canopy support. The folding front signboard assembly is comprised of two side panels and a front panel, each of the panels being generally planar and rectangular in form. The two side panels are respectively pivotally joined at one end to horizontally opposed ends of the front panel, the side panels each being respectively removably mounted to a canopy upright. The pivotal joints permit the two side panels to be folded inwardly and toward the inward facing portion of the front panel into almost face-to-face adjacency with the front panel. So folded, the front signboard assembly is in a compact arrangement for transport and storage. Being pre-assembled, the merchant or distributor need only unfold the front signboard assembly and attach the side sections to respective canopy uprights in a manner commonly known in the art.

It has been found advantageous to permanently pivotally join the side panels and the front panel through the use of rivets. To this end, the front signboard assembly panels, which are ordinarily formed of a thin but rigid sheet metal, are each provided with a flange along the upper and lower edges thereof which extends generally perpendicular from the plane of the respective signboard panel and generally inwardly relative to the assembled canopy. The flange is advantageously formed by simply bending or folding extensions of the respective front signboard assembly panels provided for this purpose, with the flanges extending along the upper and lower edges of the respective signboard panels at least adjacent the corners thereof which are to be joined, i.e., the four corners of the front panel and the corners of the side panels which carry the front panel. In assembly, and prior to delivery for use in a merchandising display, the respective flanges of the side panels and the front panels are placed in overlapping adjacency, such as with the flanges of the front panel exterior to the flanges of the respective side panels, and a rivet applied in a known manner to join the overlapped flanged portions. A folding front signboard having two side panels and a front panel which are permanently pivotally joined is thus provided to facilitate setup of a merchandise display by a merchant or distributor.

The foregoing objectives, features and advantages of the present invention will be more readily understood upon consideration of the following detailed description of the invention taken in conjunction with the accompanying drawings, in which:

DETAILED DESCRIPTION OF A PREFERRED EMBODIMENT

Figure 1:
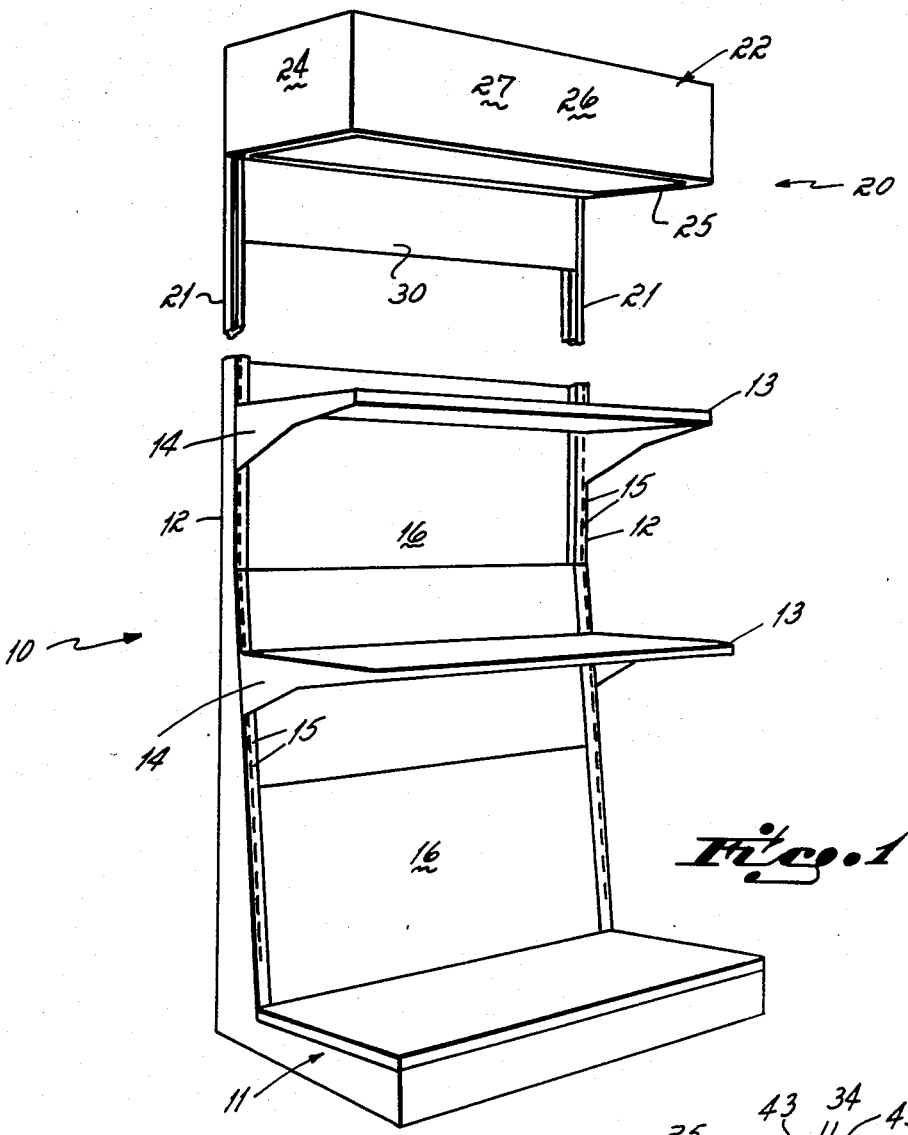
FIG. 1 is a front perspective view of a merchandise display provided with an improved canopy made in accordance with the principles of this invention, the assembled canopy and canopy support shown disassembled from the merchandise display.

Referring now to FIG. 1, an upright, free-standing merchandise display is generally indicated at 10. The forwardly facing portion of the display 10 is illustrated here in this figure. The display has a base 11 and two parallel, spaced vertical upright supports 12 which are rearwardly set and fixed to the base 11. Forwardly extending and vertically spaced shelves 13 are carried by the vertical uprights 12 in a known manner, such as through the use of brackets 14 which are fixed to or engage the shelves 13, the brackets having means, such as fingers (not shown) receivable in vertically extending elongate slots 15 provided in the vertical uprights 12. Rear panels 16 are mounted to and extend between the vertical uprights 12 to improve the appearance of the display 10 as well as to provide additional lateral support for the uprights 12 and general structure to the display 10.

The majority of the components of the display 10 are advantageously made of sheet metal which has been folded, bent, and cut in a known manner in the construction of the various components.

A canopy generally indicated at 20 is provided to improve the general appearance of the merchandise display as well as to provide an eye-catching means for promotional advertising of the displayed merchandise. The canopy 20 comprises a pair of elongate canopy uprights 21, a front signboard assembly generally indicated at 22, and a rear signboard panel 23.

Figure 2:
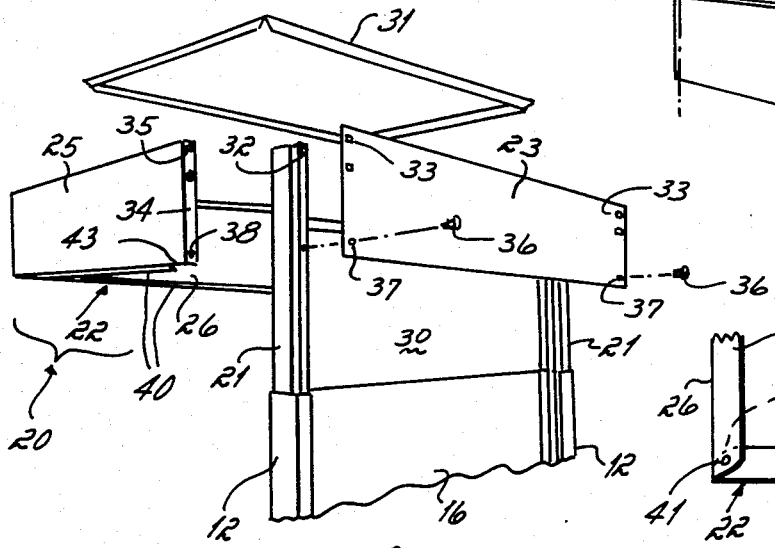
FIG. 2 is a rear perspective view of an improved canopy disassembled for illustration.

The front signboard assembly 22 has two side panels, namely a left side panel 24 and a right side panel 25, which are joined at one end to a front signboard section 26 in a manner to be more fully described below. The signboard panels 24, 25, 26 as well as the rear signboard panel 23 are advantageously made of sheet metal and are each in a generally rectangular shape. Each of the signboard panels is provided with advertising indicia thereon on the outwardly facing portions thereof, such as the outward face 27 of the front panel 26. The canopy 20 may further include a rear panel 30 similar in kind to panels 16 mounted to and extending between the canopy uprights 21 in a known manner, and top panel 31 which may take the form of a diffuser of ambient light (FIG. 2). The top panel 31 advantageously is provided to simply seat on the upper edges of the signboard panels 24, 25, 26 and 23. Like the merchandise display 10, all of the components of the canopy 22 are advantageously made of a thin, rigid sheet metal which has been appropriately folded, bent and cut to make the various components of the canopy.

The canopy uprights 21 are receivable in the vertical uprights 12 which are provided with an upwardly open interior space to receive the appropriately sized canopy uprights 21. A stop in the form of an interior shoulder or a sheet metal screw (not shown), for example, is ordinarily provided to engage and hold the canopy uprights at a point within this interior space.

With specific reference now to FIG. 2, the rear signboard panel 23 is carried on the canopy uprights 21 through the use of a mount comprising upwardly extending fingers 32 stamped or struck from the canopy uprights. The fingers 32 are received in appropriately sized apertures 33 formed in the rear panel 23.

Each of the side panels 24 and 25 is also carried by a respective canopy upright 21. For instance, side panel 25, has a vertically extending side flange 34 extending along the rearward and vertical side edge of the panel. This flange 34 is advantageously formed by bending a portion of the side panel 25 inwardly relative to the canopy 20 and generally perpendicular to the plane of the side panel 25. One or more apertures 35 are formed in this side flange 34 which receive a finger 32 therein to thereby carry the side panel on the canopy upright 21. Although not described herein, it will be understood that a like side flange with one or more apertures therein is provided for the other side panel 24 in a mirror arrangement.

In assembly, the side panels 24 and 25 will be mounted first on the fingers 32 of the canopy uprights 21, with the rear panel 23 next being mounted on the fingers 32. Additional fixation for both the side panels and the rear panel can be provided through the use of metal screws 36 extending through apertures 37, 38 provided in the rear panel 23 and side flange 34, respectively, and extending into the respective canopy upright 21 to thereby fix the canopy panels in place.

Figure 3:
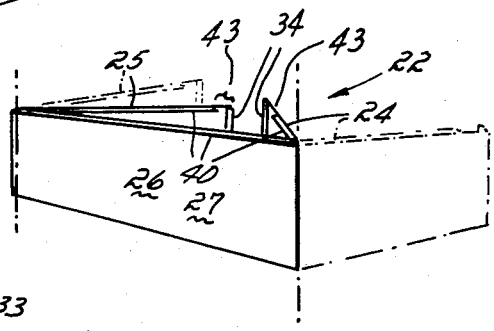
FIG. 3 is a perspective view of the folding front signboard assembly of this invention.

The improvement in this canopy structure derives from the permanent pivotal joining of the side panels 24 and 25 to the front panel section 26. As best shown in FIG. 3, this pivotal joint permits the side panel 24 and 25 to be folded inwardly relative to the canopy 20 such that the front signboard assembly 22 can be placed in a compact arrangement for storage and transport. Providing a pre-assembled folding front signboard assembly 22 to a merchant or distributor permits its ready mounting, and therefore, easy interchangeability with other signboard assemblies for the merchandise display 10.

Figure 4:
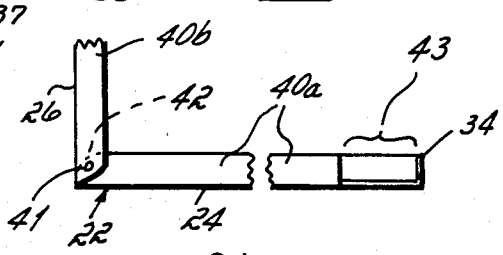
FIG. 4 is a fragmentary bottom view showing a pivotal joint of the folding front signboard assembly of FIG. 3.

With reference to FIGS. 3 and 4, each of the side panels 24 and 25 and the front panel 26 are provided with flange portions extending substantially along the upper and lower edges thereof, such as the lower flanges generally indicated at 40. These flanges extend inwardly relative to the canopy 22 and generally perpendicular to the respective signboard panel. The flanges are formed in a known manner, such as by folding an appropriate extension provided on each of the panels in the described manner.

The pivotal joint made between the respective flanges of the side and front panels is shown by the exemplary joint depicted in FIG. 4. Lower flange 40*a* of the side panel 24 is pivotally fixed to lower flange 40*b* of front panel 26 through the use of a rivet 41 which joins the two flanges 40*a* and 40*b* in overlapping engagement. Preferably, the flanges 40 will be overlapped such that the flanges of the front panel 26, such as flange 40*b*, will be exterior to the side panel flanges, such as flange 40*a*. It will be noted that the ends of the side panel flanges adjacent the front panel 26, such as the end portion 42 of flange 40*a*, is rounded off to permit the side panel to fold inwardly and toward the inward side of the front panel 26.

The end portions of the lower flanges of the side panels, such as flange 40*a*, opposite from the pivoted ends are cut away as indicated at 43 so as to receive the canopy upright 21 to which each side panel is respectively mounted in the manner previously described.

From the foregoing, it will be obvious that the improved canopy of this invention promotes relative ease and assembly of the canopy through the provision of a folding front signboard assembly which is provided to the merchant or distributor in a pre-assembled form. The front signboard assembly consequently need only be removed from its transport packaging, unfolded and mounted in place. Ready interchangeability of various folding signboards is thus also advantageously provided, since a variety of signboard assemblies may be compactly stored and kept on hand, and can be interchanged on an assembled merchandise display with relative ease.

While the principles of the invention have been detailed in an illustrative embodiment, it will be immmediately obvious to those skilled in the art many modifications of structure, arrangement, portions, elements, materials and components used in the practice of this invention which are particularly adapted for specific environments and operating requirements without departing from those principles.

What is claimed is:

1. A canopy for use in combination with a merchandise display having a base, two elongated spaced vertical display uprights extending upwardly from said base and defining an open space therebetween, and at least one generally horizontal shelf carried by the vertical uprights and spaced upwardly from the base, said canopy comprising a generally rectangular sheet metal front panel having a forward face, a rearward face and a pair of side edges, an upper flange bent from said front panel at an angle of about 90° thereto and extending rearwardly along substantially the entire length of said front panel, and a lower flange bent from said front panel at an angle of about 90° thereto and extending rearwardly along substantially the entire length of said front panel, two generally rectangular sheet metal side panels each having a forward face, a rearward face, and first and second side edges, an upper flange bent from each of said side panels at an angle of about 90° thereto and extending rearwardly along substantially the entire length of each of said side panels, and a lower flange bent from each of said side panels at an angle of about 90° thereto and extending rearwardly along each said side panel from adjacent said first side edge thereof, said upper and lower flanges of said side panels adjacent said first side edge of each side panel being juxtapositioned with the upper and lower flanges respectively of said front panel, rivet means permanently pivotally joining said juxtapositioned flanges of said side and front panels such that said side panels can be pivotally folded toward the front panel for storage or transport, and away from said front panel when in use, means adapted to join said side panels to said canopy uprights along said second side edges of said side panels, and a rectangular light diffuser mounted atop and at least partially supported from said upper flanges of said side panels.

* * * * *